US006176309B1

(12) United States Patent
Bender

(10) Patent No.: US 6,176,309 B1
(45) Date of Patent: Jan. 23, 2001

(54) BYPASS VALVE FOR GAS LIFT PLUNGER

(76) Inventor: Robert E. Bender, 7475 Rossman Gulch Rd., Morrison, CO (US) 80465

( * ) Notice: Under 35 U.S.C. 154(b), the term of this patent shall be extended for 0 days.

(21) Appl. No.: 09/164,853

(22) Filed: Oct. 1, 1998

(51) Int. Cl.[7] ..... E21B 34/14

(52) U.S. Cl. ..... 166/68; 166/105; 166/108; 166/333.1

(58) Field of Search ..... 166/68, 68.5, 105, 166/106, 108, 333.1

(56) References Cited

U.S. PATENT DOCUMENTS 1,905,058 * 4/1933 Ricker ..... 166/333.1
2,661,024 * 12/1953 Knox ..... 166/333.1
4,848,454 * 7/1989 Spears ..... 166/108
5,253,713 10/1993 Gregg et al. ..... 166/372
5,427,504 6/1995 Dinning et al. ..... 417/59
5,462,115 * 10/1995 Belden et al. ..... 166/177.3
6,045,335 * 4/2000 Dinning ..... 417/59

* cited by examiner

*Primary Examiner*—William Neuder
*Assistant Examiner*—Zakiya Walker
(74) *Attorney, Agent, or Firm*—Ancel W. Lewis, Jr.

(57) ABSTRACT

A bypass valve for a plunger in a plunger lift system in an oil and gas well is disclosed. The valve has a valve body, a piston and a spring. The pressure differential across the piston keeps the valve closed during the upstroke of the plunger. The spring opens the valve when the pressure differential decreases to below a selected value.

8 Claims, 2 Drawing Sheets

BYPASS VALVE FOR GAS LIFT PLUNGER

TECHNICAL FIELD

The present invention relates to plunger lift systems for oil and gas wells, and more particularly to a pressure sensitive bypass valve for a gas lift plunger.

BACKGROUND ART

Plunger lift systems are artificial lift systems for oil and gas wells that are used during the producing life of the well when the bottom hole pressure and the gas to liquid ratio will no longer support natural flow. A plunger lift system includes a tubing string in the well casing with a well valve and lubricator at the top and a spring assembly at the bottom, and a plunger in the tubing string. The well is intermitted by shutting in the well for a selected time period to allow pressure build up and then opening the well valve for a selected period of time, allowing fluid to flow into the sales line. The plunger moves up the tubing string during the time the well valve is open and prevents liquid fall back. When the well valve is closed the plunger falls back to the bottom of the tubing string. The open and closed times for the well valve are usually controlled by a programmable controller.

Plungers are designed to seal against the interior of the tubing string during the ascent from the bottom of the well to maximize the liquid produced during the well valve open period. The plunger seal inhibits the rate of descent of the plunger back to the bottom of the well. Prior known devices, such as the plunger disclosed in U.S. Pat. No. 5,253,713 to Gregg et al., have a rod extending from the top of the plunger that opens a bypass valve that allows fluid flow through the hollow interior of a plunger. The bypass valve allows faster descent of the plunger. The rod in these prior known devices opens the valve when the rising plunger pushes with the rod against a bumper pad in the top of the lubricator. In this type of device, if the well valve is closed before the plunger reaches the top, the bypass valve does not open and the plunger descends slowly. If the controller opens the well valve before the plunger reaches the bottom of the well and the plunger surfaces without liquid on top of the plunger, the plunger could be damaged, the lubricator could be damaged and the entire wellhead could be blown off.

U.S. Pat. No. 5,427,504 to Dinning et al. discloses a plunger bypass valve with a ball shaped closure member and a spring loaded rod activator that pushes the ball into a valve seat to close the valve. This device opens the valve after the plunger reaches the lubricator at the top of the well and the pressures above and below the plunger are equalized.

DISCLOSURE OF THE INVENTION

A plunger for an oil or gas well with an internal bypass valve is disclosed. The plunger has a hollow plunger body, a fishing neck attached to the upper end of the plunger body and a valve attached to the lower end of the plunger body. The valve has a piston biased by a spring to an open position that allows fluid to flow through the plunger and thereby increases the velocity of the plunger during the down stroke. A rod attached to and extending downwardly from the valve piston is pushed upward and moves the valve piston to a closed position when the plunger contacts the spring assembly at the bottom of the well. Opening the well at the top reduces the pressure above the plunger and the plunger travels up the well. The higher pressure below the plunger that pushes the plunger up also keeps the valve piston in the closed position. The spring moves the valve piston to the open position when the pressure difference between the bottom of the plunger and the top of the plunger falls below a selected value. The valve opens without requiring the plunger to strike a bumper at the top of the well or reach the top of the well and without requiring equalization of the pressures above and below the plunger, thereby reducing the risk of damage to the plunger and the well.

BRIEF DESCRIPTION OF THE DRAWINGS

Details of this invention are described in connection with the accompanying drawings that bear similar reference numerals in which.

DETAILED DESCRIPTION OF THE INVENTION

Figure 1:
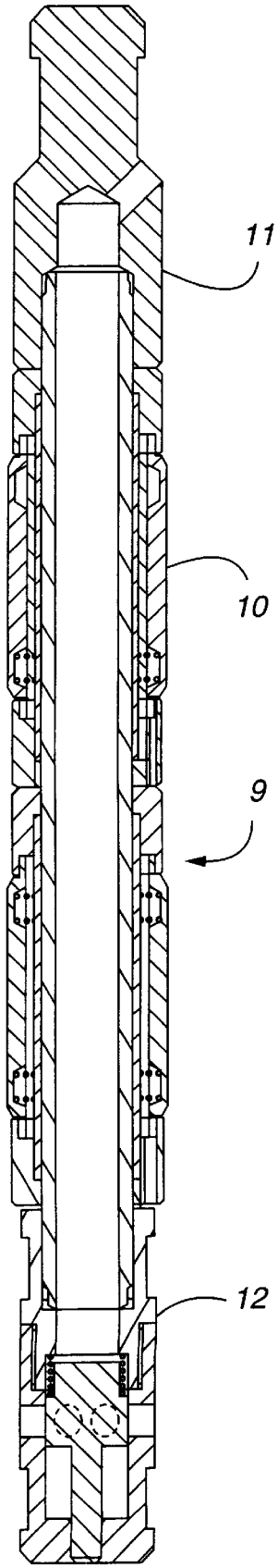
FIG. 1 is a sectional view of a plunger embodying features of the present invention.

Referring to FIG. 1, the preferred embodiment of the present invention has an elongated, hollow, cylindrical plunger body 10, a top member or fishing neck 11 attached to a top end of plunger body 10, and a plunger valve 12 attached to a bottom end of plunger body 10. Plunger body 10 is externally screw threaded at both top and bottom ends.

Figure 2:
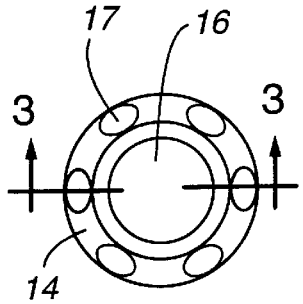
FIG. 2 is a top view of the fishing neck of the plunger of FIG. 1.
Figure 3:
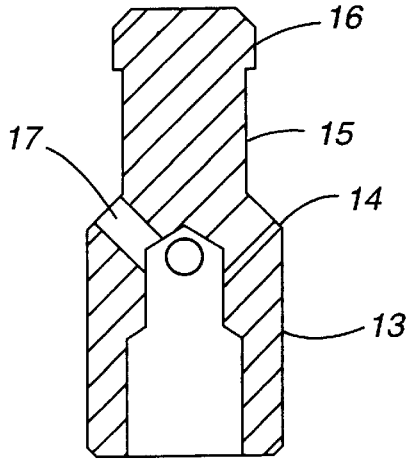
FIG. 3 is a sectional view along line 3—3 of FIG. 2.

FIGS. 2 and 3 show fishing neck 11 with an exterior size and shape corresponding to a conventional oil and gas well plunger fishing neck. Fishing neck 11 has a lower portion 13, an intermediate portion 14, an upper portion 15 and a top portion 16. Lower portion 13 is cylindrical with an exterior first diameter. The intermediate portion 14 tapers inwardly and upwardly from the lower portion 13. Upper portion 15 extends upwardly from intermediate portion 14 and is cylindrical with a second diameter smaller than the first diameter. The top portion 16 is button shaped with a third diameter intermediate the first and second diameters and attaches to the top of upper portion 15. The lower portion 13 is hollow and has internal screw threads for attachment to the top end of plunger body 10. A plurality of circumferentially spaced upper fluid apertures 17 extend outwardly and upwardly through intermediate portion 14 from the interior of lower portion 13.

Figure 4:
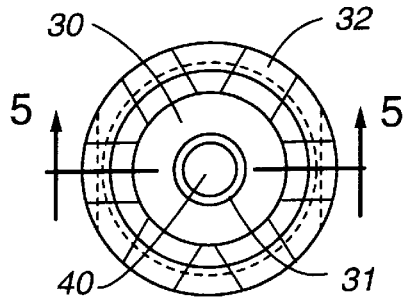
FIG. 4 is a bottom view of the valve of the plunger of FIG. 1.
Figure 5:
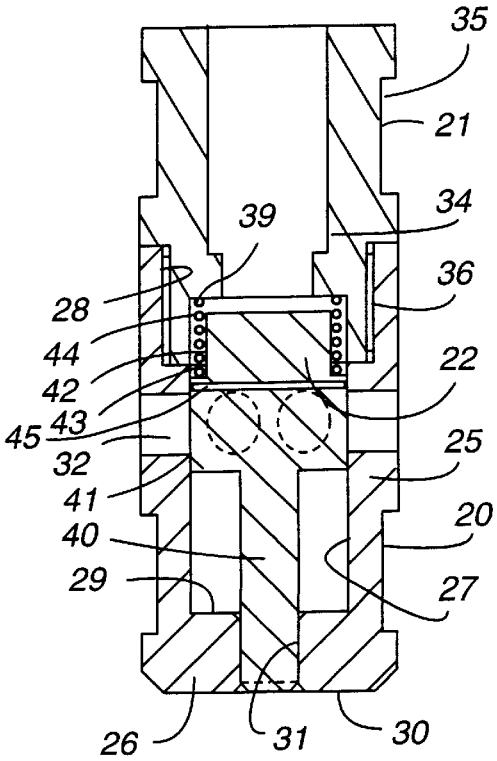
FIG. 5 is a sectional view along line 5—5 of FIG. 4 with the valve piston in the closed position.
Figure 6:
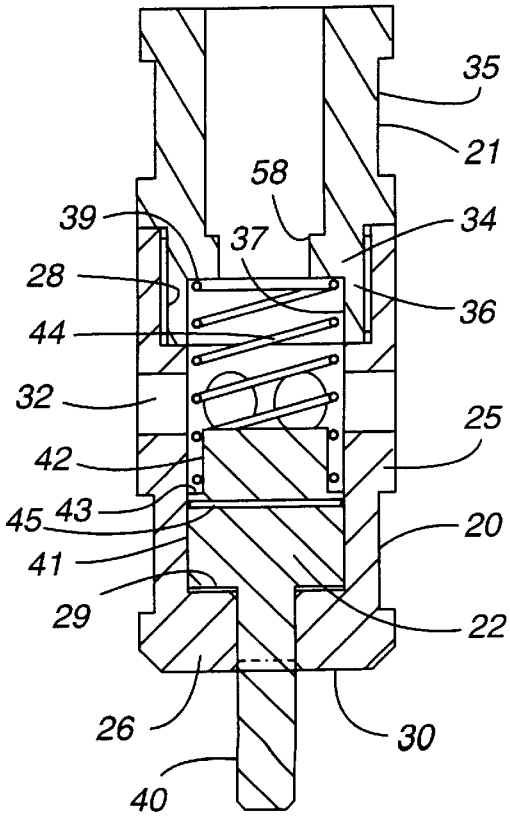
FIG. 6 is the sectional view along line 5—5 of FIG. 4 with the valve piston in the open position.

Referring now to FIGS. 4 to 6, plunger valve 12 has a first valve body portion 20, a second valve body portion 21 and a valve piston 22. The first valve body portion 20 has hollow cylindrical side wall 25 and a circular end wall 26 attached across a first end of side wall 25. The second end of side wall 25 opposite the first end is open. Side wall 25 has a smooth lower interior surface 27 adjacent to end wall 26 and a screw threaded upper interior surface 28 extending up from lower interior surface 27 and having a larger diameter than lower interior surface 27. The end wall 26 has an end wall interior surface 29, an end wall exterior surface 30 and an end wall aperture 31 that extends the center of end wall 26. A plurality of circumferentially spaced lower fluid apertures 32 extend through the side wall 25 near the top of lower interior surface 27.

The second valve body portion 21 is hollow and cylindrical, and has a lower section 34 and an upper section 35. The lower section 34 has a screw threaded exterior surface 36 sized and shaped to screw into the upper interior surface 28 of side wall 25 of first valve body portion 20. Lower section 34 of second valve body portion 21 has a cylindrical first interior surface 37 extending up from the bottom of lower section 31 and a cylindrical second interior surface 38 extending up from the top of first interior surface 37 to the top of lower section 34. The first interior surface 37 has a diameter corresponding to diameter of the lower interior surface 27 of first valve body portion 20. The second interior surface 38 has a smaller diameter than the first interior surface 37 so a downward facing first step or shoulder 39 is formed between first interior surface 37 and second interior surface 38. The upper section 35 of second valve body portion 21 extends up from the lower section 34 and is internally treaded to receive the bottom end of plunger body 10.

The valve piston 22 has an elongated cylindrical rod 40, a cylindrical intermediate portion 41 and a cylindrical upper portion 42. Rod 40 has a diameter smaller than the diameter of end wall aperture 31, extends therethrough and is slidable therein. The top end of rod 40 rigidly attaches to the bottom end of intermediate portion 41. The intermediate portion 41 has an outer diameter sized to fit with a close tolerance into the lower interior surface of first valve body portion 20 so that fluid flow is restricted between piston intermediate portion 41 and lower interior surface 27. The length of intermediate portion 41 is greater than the diameter of the lower fluid apertures 32 so that intermediate portion 41 can be disposed to completely cover lower fluid apertures 32 and thereby occlude flow through the lower fluid apertures 32. The length of rod 40 is selected such that when the bottom end of rod 40 is flush with the end wall exterior surface 30, piston intermediate portion 41 extends across lower fluid apertures 32 and occludes fluid flow through the lower fluid apertures 32. The upper portion 42 of piston 22 has a diameter smaller than the diameter of intermediate portion 41 and the bottom end of upper portion 42 rigidly attaches to the center of the top end of intermediate portion 41 so that a second step or shoulder 43 is formed around the top periphery of intermediate portion 41. The length of intermediate and upper portions 41 and 42 of valve piston 22 combined is less than the distance from the end wall interior surface 29 to the bottom of the lower fluid apertures 32 of first valve body portion 20 so that when valve piston 22 is disposed in first valve body portion 20 with the bottom of the valve piston intermediate portion 41 against the end wall interior surface 29, the flow through lower fluid apertures 32 is not restricted.

Plunger valve 12 is assembled with valve piston 22 inside first valve body portion 20 and rod 40 extending through the end wall aperture 31. The second shoulder 43 on valve piston 22 forms a seat for the bottom end of a coil spring 44. The bottom end of second valve body portion 21 is screwed into first valve body portion 20. The first shoulder 39 on second valve body portion 21 forms a seat for the upper end of spring 44. The spring 44 acts as a biasing means and biases valve piston 22 down with the bottom of the valve piston intermediate portion 41 against the end wall interior surface 29. FIG. 6 shows this open position for plunger valve 12 with lower fluid apertures 32 unobstructed and rod 40 extending beyond end wall exterior surface 30. FIG. 5 shows the closed position for plunger valve 12 with spring 44 compressed, lower fluid apertures 32 occluded by valve piston intermediate portion 41 and the bottom of rod 40 flush with end wall exterior surface 30.

Sealing means is provided that prevents fluid flow between the lower fluid apertures 32 and the interior of plunger body 10 when plunger valve 12 is in the closed position. The sealing means is shown in FIGS. 5 and 6 as an O-ring 45 around piston 22 near the top of intermediate portion 41 that seals against lower interior surface 27. The sealing means can also be a seal that extends between the top of piston 22 and first shoulder 39 when plunger valve 12 is in the closed position.

Figure 7:
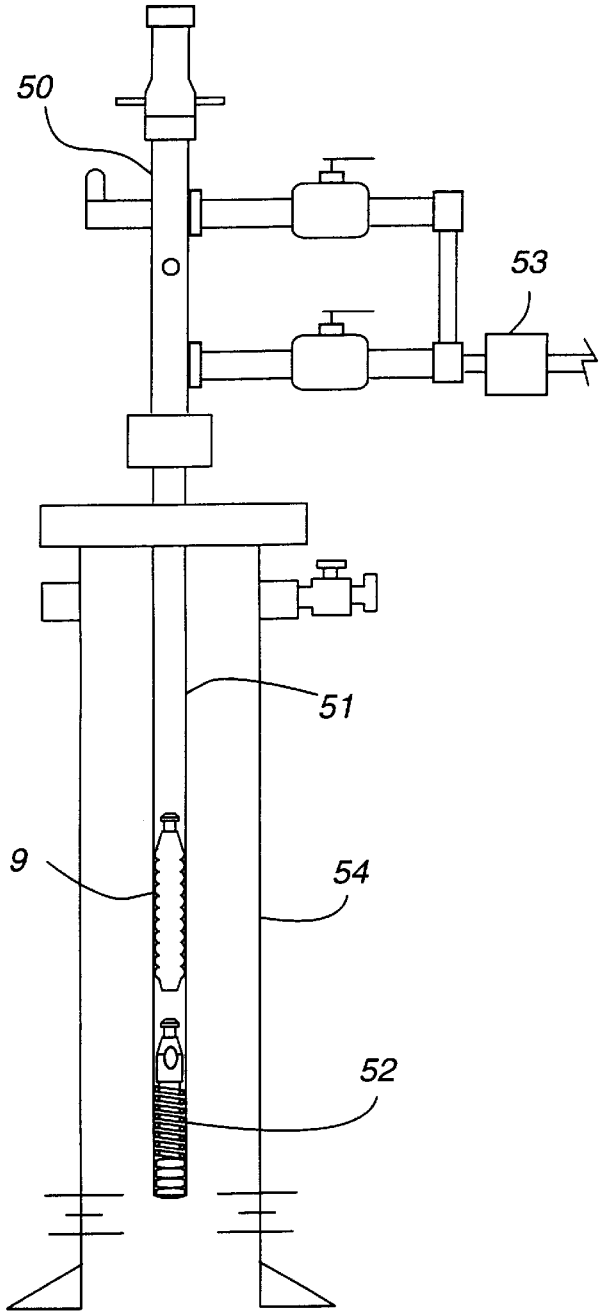
FIG. 7 is a schematic diagram of a plunger lift system for an oil and gas well that utilizes the plunger of FIG. 1.

Referring to FIG. 7, plunger valve 12 is initially in the open position when the plunger 9 is laced into the lubricator 50 at the top of the tubing string 51 of in the casing 54 of a well. The plunger body 10 preferably has a pad type seal but may have any conventional type of plunger sealing means that substantially restricts fluid flow between the plunger body 10 and the tubing string 51. The upward force on the plunger 9 is the product of fluid pressure below the plunger 9 and the cross sectional area of the plunger 9. The downward force on the plunger 9 is the weight of the plunger 9 plus the product of fluid pressure above the plunger 9 and the cross sectional area of the plunger 9. With the plunger valve 12 in the open position, the pressure above the plunger 9 and the pressure below the plunger 9 are equal and the total force on the plunger 9 is downward force of the weight of the plunger 9. The plunger 9 descends from the lubricator 50 to the bottom of the well with fluid flowing in through the lower fluid apertures 32 in plunger valve 12, up through the plunger body 10 and out through the upper fluid apertures 17 in fishing neck 11. When the plunger 9 reaches the bottom of the well, rod 40 contacts the well spring assembly 52 and pushes valve piston 22 up to the closed position.

When the plunger valve 12 is in the closed position, a pressure differential can be created between the top and bottom of the plunger 9. Opening the well valve 53 at the top of tubing string 51 allows fluid to flow out of the well and reduces the pressure above the plunger 9. When the pressure differential between the fluid above the plunger 9 and the fluid below the plunger 9 is great enough to overcome the weight of the plunger 9, the plunger 9 begins to move up the tubing string 51.

The upward force on the valve piston 22 is the product of fluid pressure below the valve piston 22 and the cross sectional area of the valve piston 22. The downward force on the valve piston 22 is the sum of the weight of the valve piston 22, the spring force from spring 44 and the product of fluid pressure above the valve piston 22 and the cross sectional area of the plunger. Spring 44 is selected such that sum the force of spring 44 on valve piston 22 in the closed position and the weight of valve piston 22 is less than the product of the pressure differential required to lift the plunger 9 and the horizontal area of valve piston 22, so as the plunger 9 rises valve piston 22 of plunger valve 12 remains in the closed position.

The spring 44 moves the valve piston 22 to the open position when the pressure differential decreases such that the downward force on valve piston 22 is greater than the upward force. The pressure differential decreases to this extent either when the plunger 9 moves into the lubricator 50 above the well valve 53 or when the well valve 53 is closed before the plunger 9 reaches the top of the well and the plunger 9 stops moving upwards. When the plunger valve 12 opens, the plunger 9 descends to the bottom of the well where the plunger valve 12 is closed by rod 40 contacting the well spring assembly 52.

Although the present invention has been described with a certain degree of particularity, it is understood that the present disclosure has been made by way of example and that changes in details of structure may be made without departing from the spirit thereof.

What is claimed is:

1. A plunger for a tubing string for a plunger lift system in an oil and gas well comprising:

an elongated plunger body with a top end, a bottom end and an inner passage, a top member at said top end of said plunger body and having at least one upper fluid aperture communicating with said inner passage of said plunger body, and a valve attached to said bottom end of said plunger body and communicating with said inner passage of said plunger body, said valve having a valve body, closure means and biasing means, said valve body having a side wall that forms a hollow cylindrical interior cavity, said side wall having a plurality of circumferentially spaced lower fluid apertures communicating with said interior cavity, said closure means having a cylindrical piston with a cylindrical external surface slidable in said interior cavity between an open position where fluid flow flows freely through said valve and a closed position, said external surface of said piston being opposite and covering said lower fluid apertures and shutting off flow through said lower fluid apertures when said piston is in said closed position, said biasing means being in contact with and biasing said piston toward said open position.

2. The plunger as set forth in claim 1 wherein said closure means includes a downwardly extending rod rigidly attached thereto that moves said closure means to said closed position when said rod contacts the bottom of said tubing string.

3. The plunger as set forth in claim 1 wherein said biasing means is a compression spring, said compression spring having a selected tension to move said closure means to said open position at a selected pressure differential between the pressure above and the pressure below said closure means.

4. The plunger as set forth in claim 1 further including a sealing means for sealing said valve when said closure means is in said closed position.

5. A plunger for a tubing string for a plunger lift system in an oil and gas well comprising:

a plunger body with a top end, a bottom end and an interior passage, a fishing neck attached to said top end of said plunger body and having at least one upper fluid aperture communicating with said interior passage of said plunger body, a valve attached to said bottom end of said plunger body and communicating with said interior passage of said plunger body, said valve having a valve body with a cylindrical side wall that forms a hollow interior cavity and a plurality of circumferentially spaced lower fluid apertures communicating with said interior cavity, a cylindrical piston slidable in said interior cavity between an open position and a closed position, and a spring that biases said piston toward said open position, said piston covering said lower fluid apertures when in said closed position and allowing unrestricted flow through said lower fluid apertures when is said open position, said piston having a downwardly extending rod rigidly attached that moves said piston to said closed position when said rod contacts the bottom of said well, said spring having a selected tension to move said piston to said open position at a selected pressure differential between the pressure above and the pressure below said piston, and sealing means for sealing between said interior passage and said lower fluid apertures when said piston is in said closed position, said sealing means including a circumferentially extending O-ring around said piston that sealingly engages said cylindrical side wall of said valve body.

6. A valve for a gas lift plunger comprising:

a hollow valve body having an open first end, a closed second end opposite said first end and a plurality of fluid apertures extending through said valve body a selected distance from said second end, said second end having an end aperture, a piston in said valve body, movable between an open position and a closed position, said piston having a rod extending therefrom through said end aperture, said rod extending beyond said second end when said piston is in said open position and being flush with said second end when said piston is in said closed position, said rod moving said piston to said closed position when said rod contacts the bottom of a well, said piston covering said fluid apertures when in said closed position, and a spring pushing against and biasing said piston toward said open position, said spring having a selected tension so that said piston is maintained in said closed position when the pressure differential across said piston is above a selected value and said spring moves said piston to said open position when the pressure differential across said piston is below said selected value.

7. The valve as set forth in claim 6 further including sealing means for sealing between said first end and said fluid apertures when said piston is in said closed position.

8. The valve as set forth in claim 7 wherein said sealing means includes an O-ring between said piston and said valve body.

* * * * *